US008091312B2

(12) United States Patent
Simpson et al.

(10) Patent No.: US 8,091,312 B2
(45) Date of Patent: Jan. 10, 2012

(54) STANDING SEAM PANEL CLIPS

(75) Inventors: Harold G. Simpson, Edmond, OK (US); Leo E. Neyer, Edmond, OK (US)

(73) Assignee: Harold Simpson, Inc., Edmond, OK (US)

( * ) Notice: Subject to any disclaimer, the term of this patent is extended or adjusted under 35 U.S.C. 154(b) by 658 days.

(21) Appl. No.: 12/188,883

(22) Filed: Aug. 8, 2008

(65) Prior Publication Data

US 2009/0044477 A1 Feb. 19, 2009

Related U.S. Application Data

(63) Continuation of application No. 11/028,994, filed on Dec. 30, 2004, now abandoned.

(60) Provisional application No. 60/533,832, filed on Dec. 31, 2003.

(51) Int. Cl.
*E04D 1/00* (2006.01)

(52) U.S. Cl. ..... 52/520; 52/521; 52/537

(58) Field of Classification Search ..... 52/520, 52/521, 536, 537, 542, 545, 547
See application file for complete search history.

(56) References Cited

U.S. PATENT DOCUMENTS

| | | | |
|---|---|---|---|
| 4,522,005 | A | 6/1985 | Seaburg et al. |
| 4,610,121 | A | 9/1986 | Schenach |
| 4,700,522 | A | 10/1987 | Simpson |
| 4,759,165 | A | 7/1988 | Getoor et al. |
| 5,038,543 | A | 8/1991 | Neyer |
| 5,193,321 | A | 3/1993 | Edwards |
| 5,212,915 | A | 5/1993 | Antonio |
| 5,349,801 | A | 9/1994 | Verbofsky |
| 5,867,959 | A | 2/1999 | Ruble et al. |
| 6,715,256 | B1 | 4/2004 | Fischer |
| 6,889,478 | B1 | 5/2005 | Simpson |

*Primary Examiner* — Jeanette E Chapman
*Assistant Examiner* — Daniel Kenny
(74) *Attorney, Agent, or Firm* — Bill D. McCarthy; Fellers, Snider, et al.

(57) ABSTRACT

A standing seam roof assembly in which a male sidelap extends from one side edge of a panel and a female sidelap extends from the opposing side edge. The female sidelap, supporting a sealant bead, is shaped fit over the male sidelap. A clip member has a clip tab shaped to be seamed with the male and female sidelaps to connect the standing seam assembly in the assembled mode. The clip tab, having a clip inclined portion with at least one sealant flow hole, with the male and female sidelaps forms lower and upper sealant chambers along a clip tab, the sealant flow hole communicating between the upper sealant chamber and the lower sealant chamber to spread sealant to encapsulate the clip tab. The clip has a clip body slidably connected to a clip base having protruding bearing feet to penetrate and compress insulation when mounted to support structure.

13 Claims, 9 Drawing Sheets

STANDING SEAM PANEL CLIPS

RELATED APPLICATIONS

The present application claims priority to U.S. Provisional Application No. 60/533,832 filed Dec. 31, 2003, entitled Standing Seam Panel Clips; and is a continuation to U.S. patent application Ser. No. 11/028,994 filed Dec. 30, 2004.

BACKGROUND OF THE INVENTION

1. Field of the Invention

The present invention relates to pre-engineered building construction, and more particularly but not by way of limitation, to improvements in standing seam panel clips for the metal roof industry.

2. Discussion

Standing seam roofs have become the most popular metal roofing assembly due mainly to the avoidance of panel penetration when securing roofing panels to underlying building support structures. Also, since the outer surfaces of a metal roofing assembly are directly exposed to a wide variety of weather conditions, standing seam roofs utilize connectors that provide for expansion and contraction of metal roof panels.

To eliminate or minimize the use of "through fasteners" (fasteners that penetrate the panels to attach them to supporting structure), standing seam metal roofs are secured to the support structure by non-penetrating clip connectors, and the sidelap joints of the standing seam metal roof panels and attaching fasteners are joined together, usually by a seaming process.

The type of seaming utilized will vary depending on the panel design. In some cases, such as in the case of simple interlocking panel arrangements, seam joinder is accomplished by snapping the panels together. In more complex designs, the seaming process will involve pressing the panel sidelaps together to initially interlock the sidelaps as the panels are positioned on the building roof support structures (typically purlins), following which seaming of the joint is achieved by either: (1) a seaming implement or machine that elastically joins the sidelaps; or (2) by a seaming implement or machine that inelastically forming (i.e., by bending and folding) the sidelaps into the standing seam assembly.

Non-penetrating clips that connect roof panels to underlying building support structure (such as purlins) are connected between overlapping panel sidelaps prior to joining and seaming. Panel clip connectors attach the roof to the building structure in the installed position, stabilizing and bracing the roof from environmental factors, such as the uplift forces of a strong wind. The clips also stabilize and brace the support structure, and provide for expansion and contraction of the roof panels as temperature gradients are imposed on the roof members and the underlying building structurals.

To secure roof panels to the underlying support structure, clips typically have tabs designed to be disposed within the panel seam. Such clip tabs are generally shaped as required by the particular shape of the panel design. Because most panels have unique shapes, each clip model is configured for a particular panel shape to which it is to be connected. One important requirement for such clip tabs is that a watertight seal be maintained about the clip tabs in the finally formed standing seam assembly.

Water tightness is usually achieved by a factory applied bead of sealant disposed on the under side of the female sidelap. As adjacent panel sidelaps are seamed, the sealant material is pressed against the top side of the male sidelap to form a watertight dam, preventing water and air from moving between the two sidelaps in the final seam assembly. At the locations where clip tabs are interposed between the male and female sidelaps, such clip tabs prevent the sealant on the female sidelap from contacting the male sidelap, with the female sidelap carried sealant instead being pressed against the tops of the clip tabs at those locations.

That is, as the sealant is compressed to flow toward the male at the clip locations, the sealant must flow around the clip tabs. While encapsulation of the clip tabs is desired, what happens in practice is that the sealant flow at the clip tabs results in gaps in the sealant between the under side of the clip tab and the top of the male side seam. It has been well verified that, because of these gaps, voids and sealant discontinuities, water and air can migrate between the under side of the panel clip tabs and the top side of the male sidelap. In time, this condition will deteriorate the sealing further (such as water freezing, roof leaks, etc.), leading to building leaks and diminished roof panel life.

Past attempts at preventing this condition have included such measures as a factory applied sealant on the underside of each clip tab that aligns with the sealant on the underside of the female sidelap when the clip tab. This sealant on the clip tab is positioned to generally align with the female sidelap carried sealant when the components of the standing seam assembly are assembled. To assure water tightness, the sealant on the female sidelap and on the clip tab, when joined and seamed, must form a continuous seal; this requires that the sealant on the clip tab extend past the tab edges in order to contact the sealant on the female sidelap during sealing. The purpose is to achieve encapsulation of the clip tab and to assure the integrity of the resultant seal between the male and female sidelaps when the seam is formed. However, tests have shown that this approach is less than totally successful, as for many reasons, the continuity of the sealant is far from perfect, there continuing to be some discontinuities in the sealant along the length of the standing seam assembly near the locations of the clips.

Furthermore, although an improvement in providing a continuing watertight seal, the placement of a sealant on the clip tab is costly in material and labor because a separate manufacturing step is required after the final clip forming operation. This means that a separate line must be provided, and that additional handling of the clips is required.

Some manufacturers have attempted to eliminate the clip sealant by designing a clip with perforations, or holes, in the clip tab, the purpose being to allow the sealant on the female sidelap to flow through the tab perforations onto the male sidelap during seaming. This has met with only limited success because the sealant flow through such perforations during seaming has not been consistent to a degree necessary to assure watertight integrity of the seal along the total length of the panel seam, as it has been shown that gaps and discontinuities frequently occur between the stream of sealant extruded through the holes and the sealant extruded around the edges of the clips.

There is therefore a need for a clip design that assures complete sealant encapsulation of the clip tabs with the seaming of a standing seam panel assembly. Preferably, as well, such design would make unnecessary having a sealant preapplied to the clip tabs prior to installation; that is, complete encapsulation of the clip tabs will be achieved by only the sealant carried by at least one of the panel sidelaps during sealing thereof.

SUMMARY OF THE INVENTION

The present invention provides an improved standing seam roof assembly in which roof panels are supported by underlying support structure in overlapping edge relationship. A male sidelap extends from a first side edge of the panels and a female sidelap extends from the opposing second side edge of each panel. The male sidelap has a male leg member and the female sidelap has a female leg member shaped to fit over the male leg member and to be seamed together.

A sealant bead is supported on the underside of the female leg member and is disposed to sealingly contact the top side of the male leg member. A clip member having a clip leg member shaped to fit over the male leg member is seamed with the male and female leg members to connect the standing seam assembly to an underlying roof support structure in the assembled mode. The clip leg member has a clip inclined portion with a sealant flow hole, and the clip leg member cooperates with the male leg member and the female leg member to form a lower sealant chamber and an upper sealant chamber along the clip leg member; the sealant flow hole communicates between the upper sealant chamber and the lower sealant chamber, and the sealant is extruded and distributed in the upper and lower sealant chambers to encapsulate a portion of the clip leg member.

The advantages and features of the present invention will become apparent when the following detailed description is read in conjunction with the drawings and appended claims.

DESCRIPTION

Figure 1:
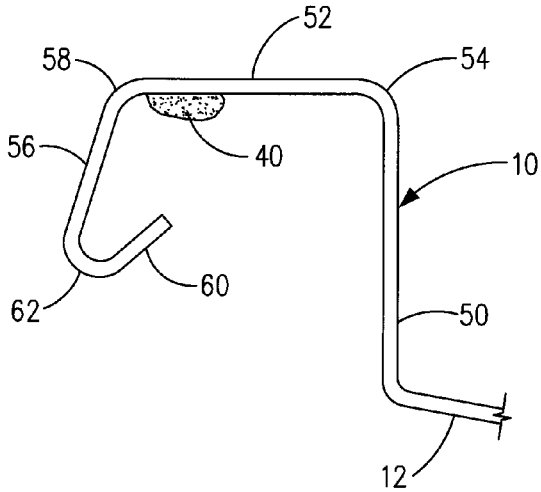
FIG. 1 is an elevational end view of a female sidelap member constructed in accordance with the present invention and having a sealant adhered to the underside of the female sidelap.
Figure 2:
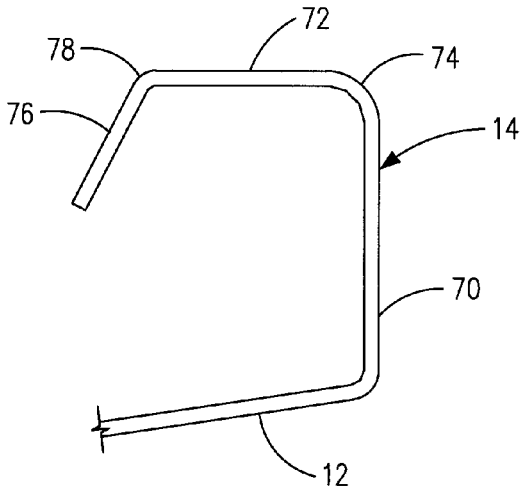
FIG. 2 is an elevational end view of a corresponding configured male sidelap member constructed in accordance with the present invention.

Referring to the drawings in general, and particularly to FIG. 1, shown therein is a female sidelap 10 formed along one longitudinal edge of a panel 12 of the kind used in multiple units to form the roof of a building structure, such as a pre-engineered metal building. Shown in FIG. 2 is a male sidelap 14 formed along the opposite side edge of the panel 12.

Figure 3:
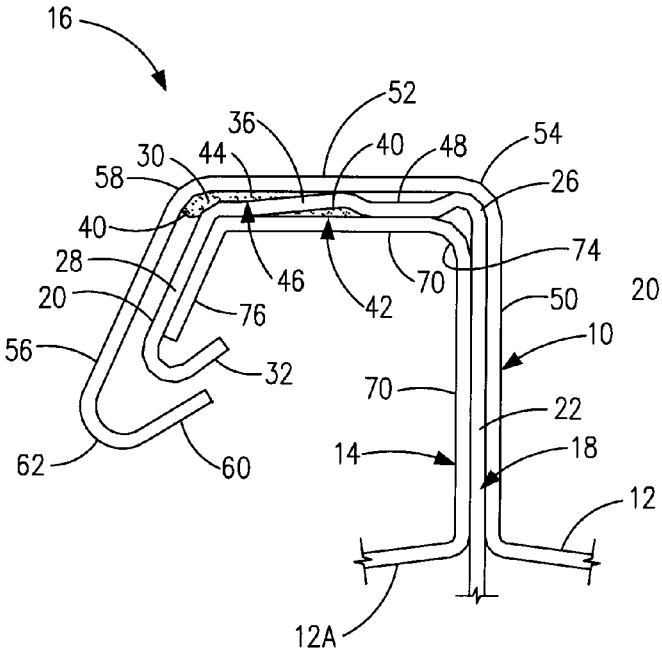
FIG. 3 is an end, cross-sectional view of a standing seam assembly having joined together female and male sidelaps of FIGS. 1 and 2.

FIG. 3 shows a standing seam assembly 16 that is formed when the male sidelap 14 of a side-adjacent panel 12A is inserted into the female sidelap 10 of the panel 12. It will be understood the roof containing the panels 12 and 12A will have a series of like panels positioned in side-adjacent juxtaposition on supporting structures, such as purlins, with the side edges being formed into standing seams like the standing seam assembly 16 depicted in FIG. 3. Each such panel used in forming the roof will have one side edge formed in the shape of the female sidelap 10 along one longitudinal edge, and will have its opposite side edge formed in the shape of the male sidelap 14 along the opposite longitudinal edge. The female sidelap of one panel will be joined with the male sidelap of an adjacently disposed panel to form the standing seam assembly 16.

Figure 4:
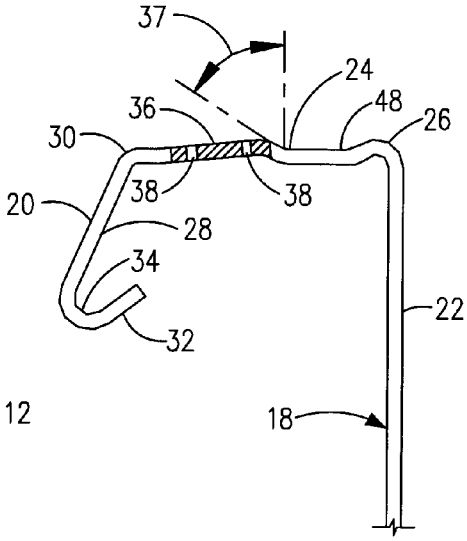
FIG. 4 is an end, partially cutaway, cross-sectional view of a clip member also constructed in accordance with the present invention and configured to connect to the standing seam assembly of FIG. 3.

FIG. 4 shows a clip member 18 that hooks over the male sidelap 14 of panel 12A before the male sidelap 14 is inserted into the female sidelap 10 of the panel 12 to form the standing seam panel assembly 16. The clip 18 has a clip tab 20 that is formed to permit sealant passage there through; further, the clip 18 has a first leg member 22, preferably extending generally perpendicular to the medial portion of panel 12A; a clip second leg member 24 extending angularly from the first leg member 22 at a clip apex radius portion 26; and a third leg member 28 extending angularly from the clip second leg member 24 at a clip intermediate radius portion 30. In the embodiment shown, the clip 18 has a fourth leg member 32 extending angularly from the third leg member 28 at the clip distal radius portion 34 and generally toward the aforementioned portions of the clip 18.

The medial portion of the clip second leg member 24 of the clip 18 is crimped to form an angularly clip first inclined portion 35 and a clip second inclined portion 36, the clip second inclined portion 36 being perforated to have a plurality of sealant flow holes 38. The clip sealant flow holes 38 can be regular in shape (such as slots or circular holes) or irregular in shape, and the clip sealant flow holes 38 can be spaced uniformly or non-uniformly down and across the clip inclined portion 36, to accommodate different sealant flow rates there through so as to achieve encapsulation of the clip tab 20 to form a water tight seal.

Returning to FIG. 1, the underside of the female sidelap 10 has a bead of sealant 40 that extends along the length of the sidelap edge of the panel 12. The sealant 40 is preferably factory-installed, but as appropriate, can be field installed prior to assembly. It will be understood that several of the clips 18 will be hooked at intervals along the length of the male sidelap 14, and once in place, the female sidelap 10 will be positioned over the male sidelap 14 and the clips 18 in the manner illustrated in FIG. 3. In this position, it will be understood that the location of the sealant bead 40 on the female sidelap 10 will be determined such as to generally align with the clip inclined portion 36, and thus, with the sealant flow holes 38 of the clips 18.

During initial assembly of the standing seam assembly 16, as the female sidelap 10 is joined with the male sidelap 14 with the clips 18 hooked there over, the assembly process forces, or extrudes, the sealant 40 through the sealant flow holes 38 in the clip inclined portion 36 of the clip 18 into a lower sealant chamber 42 formed between the clip inclined portion 36 and the male sidelap 14, as shown in FIG. 3. A portion of the sealant 40 will flow longitudinally along the lower sealant chamber 42 for the length of clip tab 20.

FIG. 3 depicts the components following the initial assembly of the standing seam assembly 16, that is, before any seam forming, or seam rolling, has been performed. It will be noted that the weight of the female sidelap 14 borne by the sealant bead 40 will cause it to deform from its initial shape depicted in FIG. 1 to assume a first compressed sealant shape 44 (shown in FIG. 3), a portion of the sealant 40 being forced to flow into an upper cavity or upper sealant chamber 46, formed between the under surface of the female sidelap 10 and the upper surface of the clip inclined portion 36. And, as noted, a portion of the sealant 40 will be forced to flow into the lower sealant chamber 42, effectively sealing the male and female sidelaps between the locations of the clip members 18.

Figure 5:
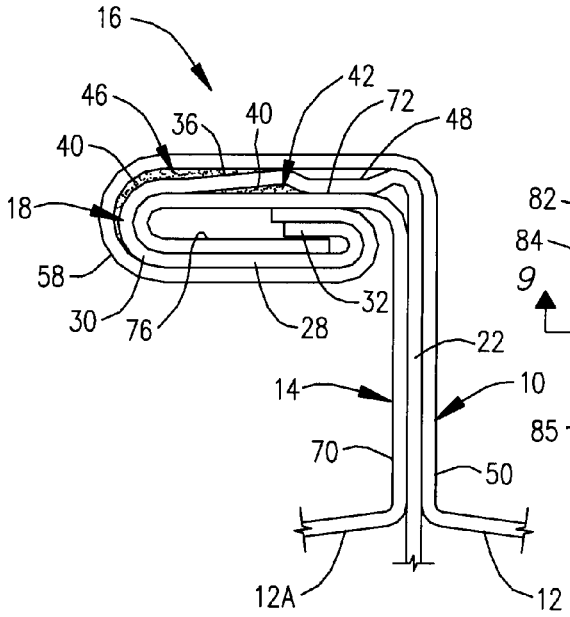
FIG. 5 is a view of the standing seam assembly of FIG. 3 after being inelastically seamed by a seaming tool/machine.

FIG. 5 illustrates one possible final shape of the standing seam assembly 14 at the locations of the clip members 18 after the male and female sidelaps have been formed by a sealing tool/machine, such sealing tool/machine being conventional except for the shape achieved by the particular dies at hand, as will be understood by one skilled in the art. The sealant 40, flowing under compressive force, flows from the upper sealant chamber 46 through the sealant flow holes 38 to the lower sealant chamber 42 and around the end edges of the clip tab 20. This will be further described below with reference to FIGS. 6 through 9. It will be understood that the male and female members 14, 10 can be: (1) continuously seamed (by the aforementioned sealing tool/machine) between the locations of the clip members 18, including at the locations of the clip members 18; (2) seamed (by the sealing tool/machine) only at the locations of the clip members 18; or (3) any combination of (1) and (2) intermittently as may be desired.

It will be noted that the lower sealant chamber 42 and the upper sealant chamber 46 have cross sectional profiles that are generally triangularly shaped. The sealant chambers 42, 46 are protected from collapse by the crimped clip first inclined portion 35, and further, by a crimped dimple portion 48 formed between one end of the clip first inclined portion 35 and the clip apex radius portion 26 (between the clip first leg member 22 and the clip second leg member 24) as shown in FIG. 4.

It should also be noted that the angle of incline 37 of the more vertical clip first inclined portion 35 may be varied to adjust the resistance to collapse of the lower sealant chamber 42 and the upper sealant chamber 46, as well as the amount of spring back occurring. The more vertical the position of the clip first inclined portion 35, the greater the resistance to collapse and the less spring back that will occur, unless the clip first inclined portion 35 is eliminated altogether. It should also be noted that the angle of incline of the clip second inclined portion 36 may be varied to increase or decrease the distance between the clip apex radius portion 26 and the clip intermediate radius portion 30 to accommodate different panel shapes.

The triangular profiles of the sealant chambers 42, 46 result in sealant cavities in which the sealant is significantly thicker than that achieved by conventional clip to panel configurations in which the surface contact does not provide such sealant cavities. The benefit of the sealant thickness achieved by the present invention becomes apparent to one skilled in the art when considering the phenomena of metal "spring back." As the sidelap seam is formed by the sealing tool/machine, the lower sealant chamber 42 and the upper sealant chamber 46 are slightly compressed and the metal will have a certain amount of metal spring back to its pre-seamed condition, and a thicker bead of sealant, such as in the sealant chambers 42 and 46, will provide a greater elastic length so that a set limit on unit elasticity can accommodate a greater overall movement without failure to better accommodate and compensate for the spring back and compression during seaming.

Seaming pressure and metal spring back will cause the seam cavities to close and then open somewhat, and the greater thickness of the sealant bead in the sealant chambers 42, 46 insures that the sealant is not broken or displaced during the seaming process. Rather, when the spring back occurs, allowing some separation of the female sidelap 10, the male sidelap 14 and the clip tab 20, the sealant 40 prevents creation of water flow paths between the seam components, thereby substantially eliminating potential leaks. Thus, the sealant bead 40 adhered to, and carried by, the underside of the female sidelap 10, forms a watertight barrier between the female sidelap 10 and the male sidelap 14 even at clip locations.

FIG. 3 depicts the relation of the components during the initial assembly of the male sidelap 14, the female sidelap 10 and the clip member 18, and it should be noted that only the upper portion of the clip 18 is shown in this view, the lower portion being configured to attach to underlying support structure of the building on which the panel members are installed.

The dimple portion 48 of the clip 18 supports the clip second inclined portion 36 above the male second leg member 72 of the male sidelap 14 to form the sealant chamber 42. That is, the sealant chamber 42 is positioned between the clip intermediate radius portion 30 and the dimple 48, and the lower sealant chamber 42 is formed by the upper surface of the male second leg member 72 of the male sidelap 14. The sealant flow holes 38 that communicate with the lower sealant chamber 42 can vary in number and can be of various shapes and sizes depending on the clip tab tooling requirements and the sealant flow characteristics, including durometer, surface tension, etc.

The upper sealant chamber 46 is formed between the underside of the female second leg member 52 of the female sidelap 10 and the upper surface of the clip second inclined portion 36 at each clip location, as depicted in FIGS. 3-5. As the female sidelap 10 is positioned over the clip member 14 and the male sidelap 14, a portion of the sealant 40 is caused to flow by compression thereof, assuming the first compressed shape 44 shown in FIG. 3. This partial compression causes the sealant to flow along the upper sealant chamber 46 of the clip tab 20 and through sealant flow holes 38 in the clip tab 14. Preferably, the sealant flow holes 38 are spaced at appropriate longitudinal intervals along the clip tab 20 in a staggered lateral pattern, so as to help assure a portion of the sealant flows into the lower sealant chamber 42.

Returning to FIG. 1, it will be noted that the female sidelap 10 has a female first leg member 50 preferably extending generally perpendicularly to the medial portion of the panel 12; a female second leg member 52 extending angularly from the female first leg member 50 at a female apex radius 54; a female third leg member 56 extending angularly from the female second leg member 52 at an intermediate female radius portion 58; and a female fourth leg member 60 extending angularly from a distal female radius portion 62.

In FIG. 2, the male sidelap 10 has a male first leg member 70 preferably extending generally perpendicularly to the medial portion of the panel 12; a male second leg member 72 extending angularly from the male first leg member 70 at a male apex radius 74; and a male third leg member 76 extending angularly from the male second leg member 72 at a male intermediate radius portion 78.

As shown in FIG. 5, after the standing seam assembly 16 has been inelastically seamed and the seaming process has formed the components into the shape shown, the components of the female sidelap 10, the female apex radius portion 54, the female intermediate radius portion 58 and the female distal radius portion 62, are stretched and tightly compressed against the components of the clip 18: the clip apex radius portion 26, the clip intermediate radius portion 30 and the clip distal radius portion 34, respectively.

The inelastic seaming of the standing seam assembly 16 has caused a partial closure of the upper sealant chamber 46 between the clip intermediate radius portion 30 and the female intermediate radius portion 58 of the female sidelap 10 along the upper surface of the clip second inclined portion 36, as shown. Thus, the upper sealant chamber 46 is formed by the underside of the female sidelap 10 and the top surface of the clip member 18, including at least partially around the intermediate radius portion 30. The seam forming process reduces the volume area in which the sealant 40 was disposed following the initial extruding force that was exerted (as discussed above for FIG. 3) by partially bearing the weight of the female sidelap 10, thus creating an additional second surge of extruding force that further forces sealant in the upper chamber 46 through the sealant flow holes 38 into the lower sealant chamber 42 where the sealant 40 is caused to travel longitudinally along the lower sealant chamber 42 to seal along the top of the male second leg member 72.

Figure 8:
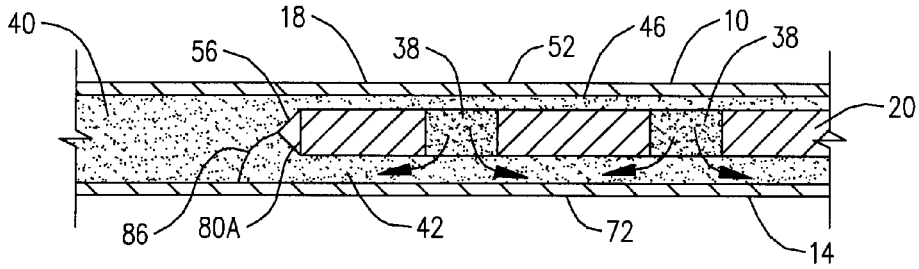
FIG. 8 shows a sectional view of a cut longitudinally through the top of joined male and female sidelap members of FIGS. 1 and 2 and illustrating the sealant flow through sealant flow holes in the clip member of FIG. 4 when the attached clip member is square ended.

The upper sealant chamber 46 which forms a dam against the underside of the female second leg portion 52 of the female sidelap 10, and sealant 40 in the upper sealant chamber 46, being compressed by the seaming process, causes a portion of the sealant 40 to flow toward the clip intermediate radius portion 30 of the clip 18 and out and over the clip first and second end edges 80, 82 (see FIG. 8). However, the sealant 40 is prevented from freely flowing past the clip intermediate radius portion 30, since the female intermediate radius portion 58 and the clip intermediate radius portion 30 are stretched together to prevent further passage of sealant. Thus, the interference created from seaming compression of the female sidelap 10 over the clip member 18 will cause part of the sealant 40 in the upper sealant chamber 46 to extend along the width and length of the clip tab 20, joining with the portion of sealant 40 that is pressed through the sealant flow holes 38 into the lower sealant chamber 42, to seal around the end edges and ends of the clip 18. With the sidelaps 10, 12 inelastically formed into the shape shown, the applied compressive forces cause the sealant 40 to essentially encapsulate the clip inclined portion 36.

Figure 7:
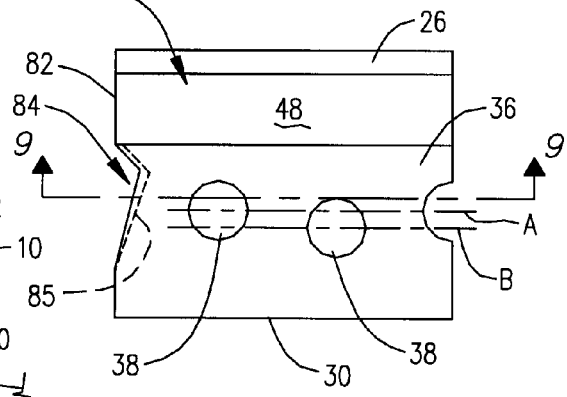
FIG. 7 is a top plan view of one end edge portion of the clip of FIG. 6 showing the notch therein.
Figure 6:
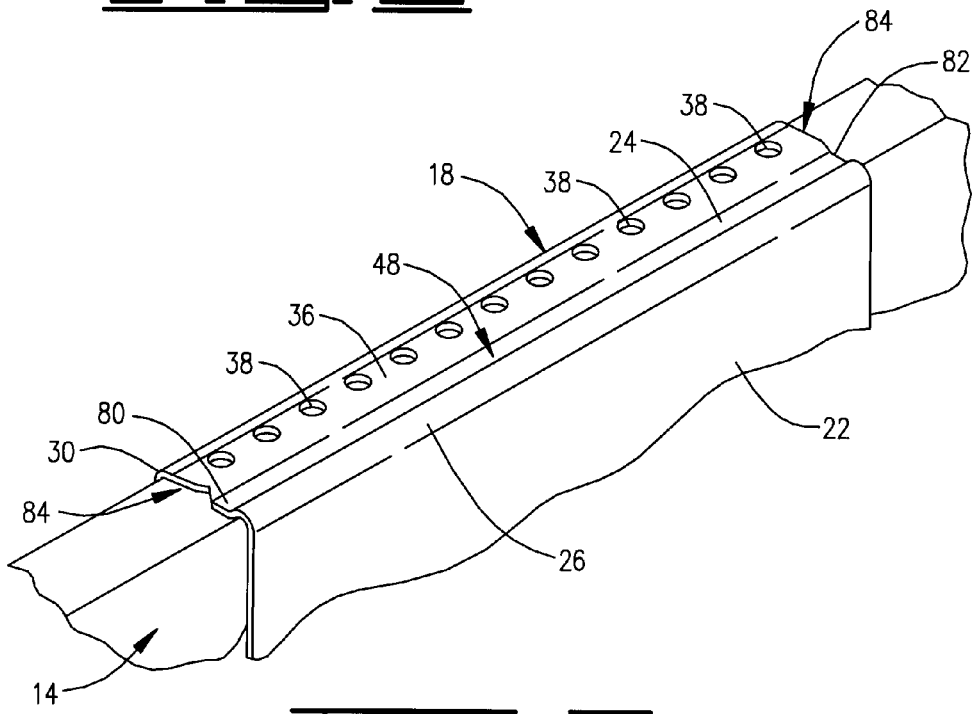
FIG. 6 is a perspective, partial view the clip member of FIG. 4 hooked over the male sidelap of FIG. 2.

Turning now to FIGS. 6 and 7, illustrated therein is a portion of the clip 18 showing further details of the clip inclined portion 36 of the clip second leg member 24. In FIG. 6 the clip 18 is hooked over the male sidelap 14 prior to installation of the female sidelap 10. FIG. 7, which shows the clip 18 having a clip first end edge 80 and a clip second end edge 82, is provided as the best view to describe the notching of the clip ends. The clip end edges 80, 82 of the top portion of the clip tab 20 have tapered notches 84, and the notches 84 preferably are smooth and generally free of burring, having coined notch portions 85.

Figure 9:
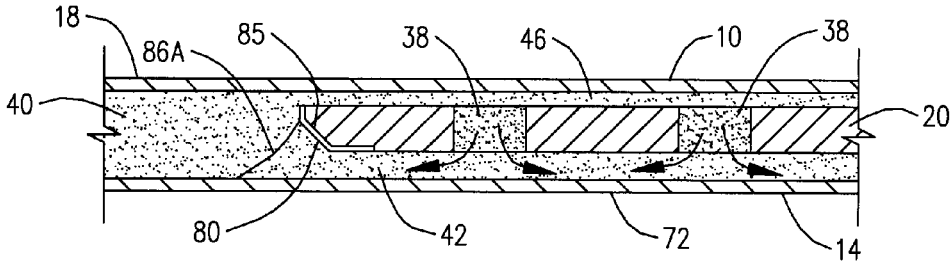
FIG. 9 is a view similar to that of FIG. 8 but with the clip member constructed in accordance with the present invention.

Reference will now be made to FIGS. 8 and 9 to illustrate the purpose of the notches 84 of FIGS. 6 and 7, having coined notch portions 85, as these tapered, smooth edges assure integrity and achieve continuity of the sealant 40 at the locations of the clip members 18 in the standing seam assembly 16. FIG. 8 is a sectional view cut longitudinally through the standing seam assembly 16 at the sealant flow holes 38 in the clip second inclined portion 36 of the clip member 18. This view illustrates the sealant 40 in the upper and lower sealant chambers 46, 42 at a panel clip location. However, in FIG. 8, instead of having the preferred notched ends 80, 82, the clip 18 is depicted as though the clip 18 has a square cut end 80A; that is, the end 80 of the clip member 18 will be considered momentarily as not having tapered, notched ends.

Thus, FIG. 8 depicts what can be expected when the sidelaps 10 and 14 have been seamed with the clip 18 having square formed ends, with the sealant 40 having been forced to flow into the upper and lower sealant chambers 46, 42, as previously described. Also, the sealant 40 on the underside of the female second leg member 52 of the female sidelap 10 has joined with the sealant on top of the male second leg member 72 of the male sidelap 14 along the seam joint; and, a portion of sealant 40 that flowed through the sealant flow holes 38 into the lower sealant chamber 42 has been extruded out and around the clip square cut end 80A.

Both the sealant 40 above the clip tab 20 and the portion of the sealant 40 extruded into the sealant chamber 42 in FIG. 8 are united at a sealant boundary line 86. However, because there is much less extruding force exerted at the ends of the clip 18 (due to the greater cross section there) and due to the inability of the sealant to flow vertically down due to its flow characteristics (viscosity, cohesion, adhesion, etc.) or to flow upwardly up the square cut end 80A, both sealant portions join at the sealant contact line 86. As the compressed sealant portions (that flowing out the end of the lower sealant chamber 42 and that flowing out the end of the upper sealant chamber 46), a sealant void 88 is created, disrupting the integrity of the sealant and providing unwanted voids that lead to fissures in the sealant and potential water leakage routes.

FIG. 9, on the other hand, illustrates what happens to the sealant 40 when the clip member 18, rather than having square cut ends, is provided with the tapered end notches 84 as described with reference to FIGS. 6 and 7 above. This inventive configuration at the ends of clip tab 20 allows the sealant 40 above the clip tab 20 (in the upper sealant chamber 46) and the sealant below the clip tab 20 (in the lower sealant chamber 42) to merge at the boundary line 86A without a sealant void. That is, this feature assures that the sealant 40 compressed to fill the lower sealant chamber 42 and the upper sealant chamber 46 will unite at the boundary line 86A to provide continuity of the watertight seal, assuring seal integrity continuously along the entire length of the seam. The reason for this is that, in FIG. 8, the inner surface of the notch is located away from the end of the clip 18 where the sealant is compressing and forced flow of the sealant is occurring.

The sealant flow holes 38 in FIGS. 6 and 7 are shown in a staggered pattern, with some of the holes centered on a longitudinal axis A and some holes centered on a longitudinal axis B, and it will be appreciated that the flow holes can be staggered as may be required when a greater alignment tolerance between the flow holes 38 and sealant 40 is desired, thereby facilitating adequate flow of the sealant 40 into the lower sealant chamber 42. Depending on the dimensions, this can be useful in assuring a uniform water entry prevention dam, and such staggered hole pattern will accommodate greater location tolerances for the placement of the sealant 40 on the under side of female sidelap 10 and for the dimensions of the clip member 18.

Figure 10:
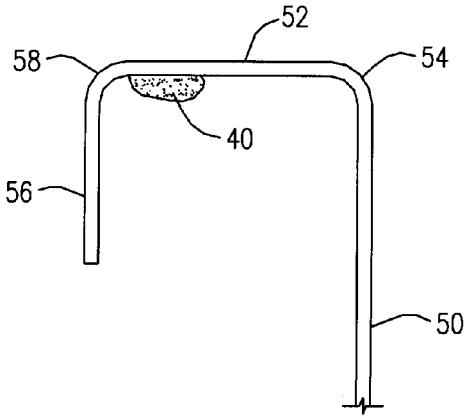
FIGS. 10 through 12 depict the components of another embodiment of a standing seam assembly constructed in accordance with the present invention.
Figure 11:
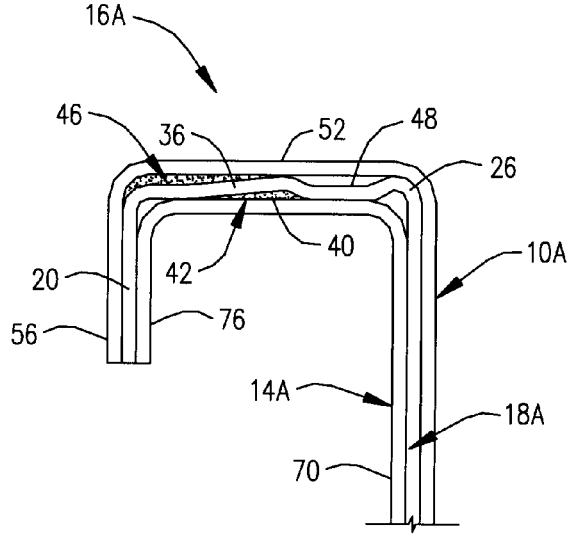
Figure 12:
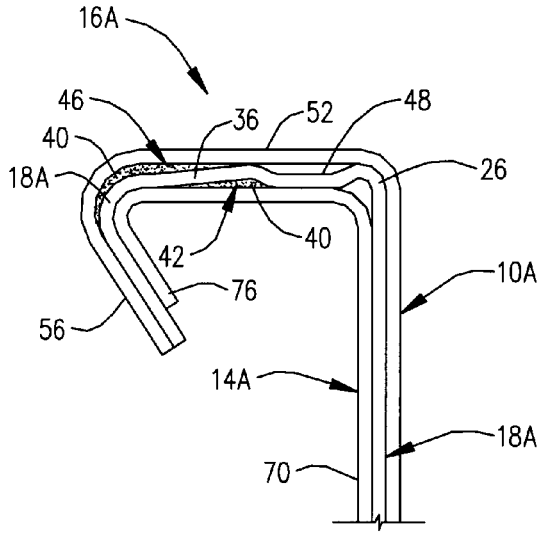

FIGS. 10 through 12 depict another embodiment of the present invention in which a female sidelap 10A, a male sidelap 14A and a clip 18A are depicted as forming a standing seam assembly 16A. Where the component parts are the same as those described herein above for the standing seam assembly 16, identical component numbers are depicted. Further description is not believed necessary as the purpose of including FIGS. 10-12 is to illustrate that the present invention can be incorporated in other embodiment shapes of the finally formed standing seam assembly, and the above description for the standing seam assembly 16 is incorporated by reference to that of the standing seam assembly 16A.

Figure 13:
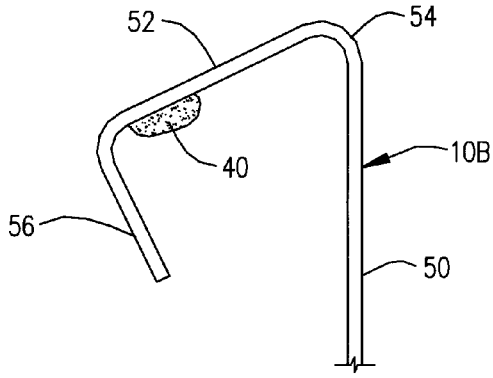
FIGS. 13 through 15 depict the components of yet one more embodiment of a standing seam assembly constructed in accordance with the present invention.
Figure 14:
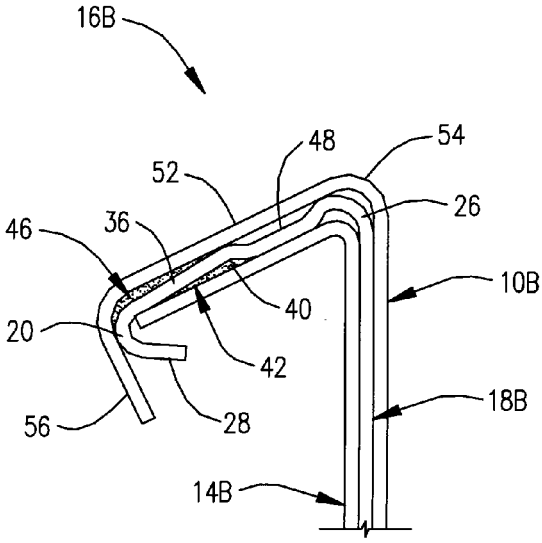
Figure 15:
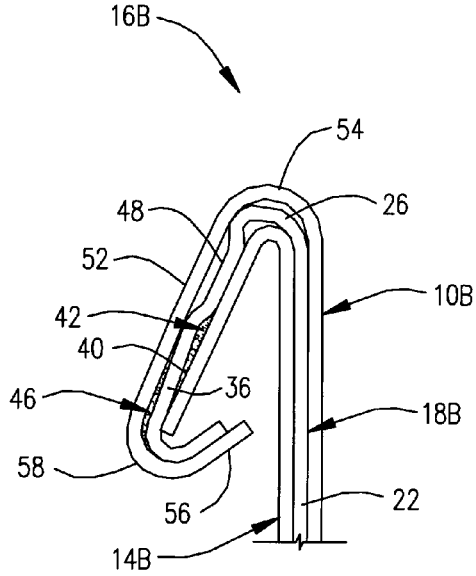

FIGS. 13 through 15 depict another embodiment of the present invention in which a female sidelap 10B, a male sidelap 14B and a clip 18B are depicted as forming yet another standing seam assembly 16B. Where the component parts are the same as those described herein above for the standing seam assembly 16, identical component numbers are depicted. Further description is not believed necessary as the purpose of including FIGS. 13 through 15 is to illustrate that the present invention can be incorporated in other embodiment shapes of the finally formed standing seam assembly, and the above description for the standing seam assembly 16 is incorporated by reference to that of the standing seam assembly 16B.

Turning to another beneficial attribute, it should be noted that the clip member 18, described above, can provide added stabilization for the roof purlins of a building structure. As will be appreciated by one skilled in the art of metal panel roofs, a purlin load force can cause a translation or rotation of a zee or a cee purlin. The panel clip can be designed to resist a portion of such force tending to cause the purlins to translate or rotate by transferring a portion of the force required to resist such movement through the clip to the seam of a standing seam panel assembly of the type discussed herein where it is then transferred to other portions of the building structure.

The clip members of a standing seam panel roof are usually installed over a blanket insulation of from 2 to 6 inches in thickness placed over the supporting roof purlins. When the base of the clip members are attached to the roof purlins, this blanket insulation will be compressed, the amount of such compression depending on the thickness and type of insulation and the compressive force placed on the insulation, unless means are incorporated in the clip base to prevent or limit the compression of the blanket insulation.

This compressibility of blanket insulation can permit clip bases to move, or rock, on the purlin surfaces, and this in turn allows the purlins to rotate, thus reducing the purlin load carrying capacity. The clip base of the invention has rigid penetrating clip base support feet spaced laterally apart. These feet concentrate the compressive force over a small area so the feet compress the insulation to the point where it is virtually solid and the clip base will not rock.

FIGS. 16 through 19 show the clip member 18 that has been described in part herein above. As shown, the clip 18 has a clip body 90 having an upstanding clip first leg member 22 and a clip base 92, the clip body 90 slidably connected to the clip base 92. This sliding movement is the means whereby the roof panels are permitted to expand and contract with gradient temperature changes between the roof panels the support purlins. Thus, differential movement between the clip tab 20 and the standing seam assemblies 16 is prevented, with differential movement between the purlin and the panels is compensated for by the clip 18 sliding in its base 92.

Figure 16:
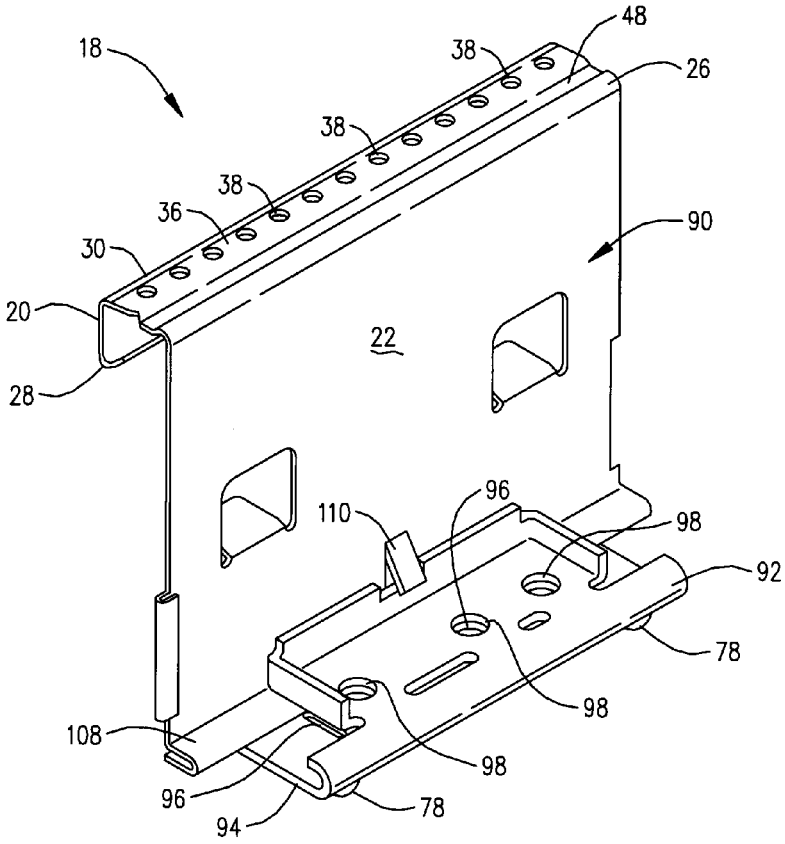
FIG. 16 is an isometric view of the clip of FIG. 4.
Figure 17:
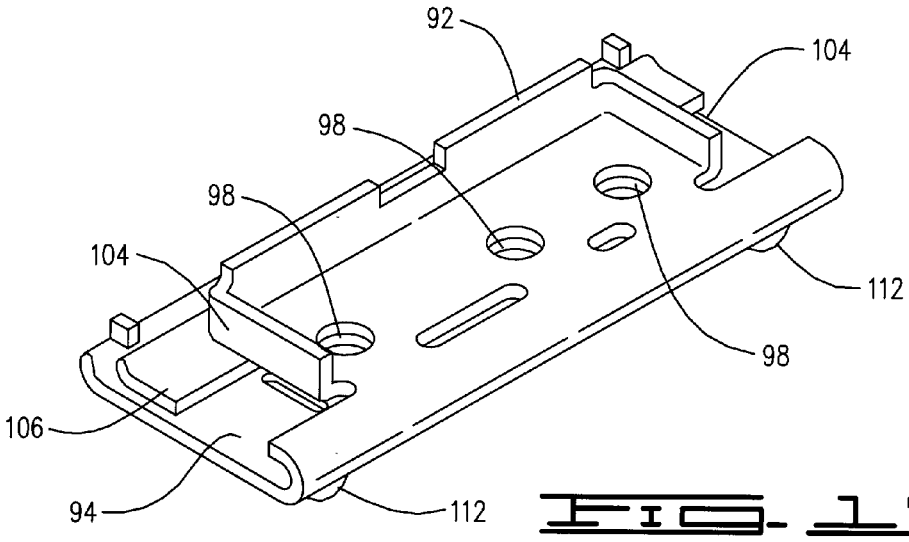
FIG. 17 is an isometric top view of the base portion of the clip of FIG. 4.
Figure 18:
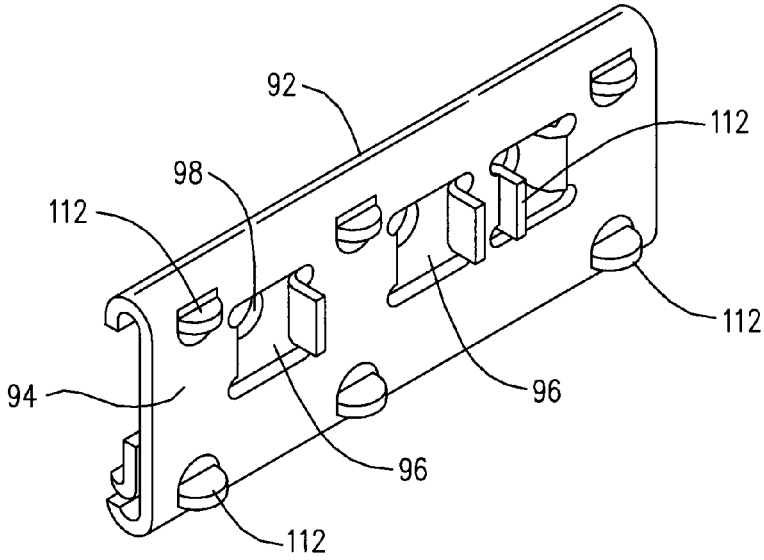
FIG. 18 is an isometric bottom view of the base portion of the clip of FIG. 4.
Figure 19:
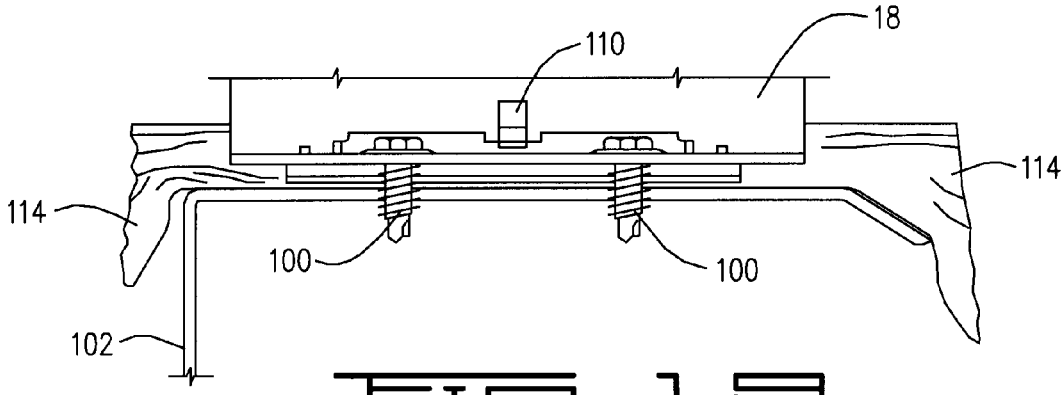
FIG. 19 is a partial, elevational view of the clip of FIG. 4 attached to a supporting purlin member.

As will be noted in FIGS. 16-18, the clip base 92 has a web portion 94 that folds back under the upstanding clip first leg member 22 of the clip body 90, the web portion 94 having several base clearance holes 96. The clip base 92 has a plurality of clip fastener holes 98 equal in number to the base clearance holes 96 and each clip fastener holes 98 having a vertical axis coincident with one of the base clearance holes 96 so that clip fasteners 100 can pass there through to attach the clip base 92 to a supporting purlin 102 (as shown in FIG. 19).

The clip fasteners 100 are purposefully established in a line that is parallel (as opposed to perpendicular) to the clip tab 20 of the clip 18, as this is advantageous in resisting forces on the clip tab 20. That is, the force exerted by wind uplift load on the roof panels are transferred through the clip tab 20 to the clip base 92; this force is in turn transferred substantially equally to the clip fasteners 100, allowing these multiple fasteners to share equally the force load received by the clip base 92. If the clip fasteners 100 were positioned along a line substantially perpendicular to the clip tab 20, as is the case in prior art structures, a preponderance of the transferred force would first go to the clip fastener 100 closest to the clip tab. Once the closest fastener failed, all the transferred force would then be transferred to the next fastener in line, which would be subject to failure at substantially the same load as the closest fastener had been, the only practical purpose thus being served by the most distant fasteners would be that of backup to failure of the other closer fasteners. It will be appreciated that the holding force of the clip 18 is increased when all the fasteners 100 share portions of the transferred load and work together, being loaded equally.

FIGS. 17 and 18 provide further details of construction of the clip base 92. The area around the fastener holes 98 is reinforced by stiffening lips 104 that are formed along the sides and adjacent to where the fastener holes 98 are disposed. The stiffening lips 104 reinforce the clip base 92 to receive the uplift load transferred from the clip tab 20 and transferred to the clip fasteners 100.

The web portion 94 folds over itself to form a clip retaining tongue 106, and the bottom portion of the clip first leg member 22 is folded into a groove forming, base connector portion 108 that receives the clip retaining tongue 106. This permits the clip body 90 to slide relative to the clip base 92, with appropriate limiting stops being provided to restrict the total movement allowed, such as the tab and slot stop 110 (other stops can be provided as well along the base connector 108).

The clip base 92 has a plurality of bearing tabs or feet 112. The bearing tabs 112 are spaced about the bottom of the clip base 92 and serve to penetrate and embed the underlying blanket insulation so as to compress the insulation under them; this serves to place the support of the clip base 92 and its load substantially directly on the purlin 102. This is depicted in FIG. 19 where the clip base 92 has been placed over a compressible fiber glass blanket insulation 114; the clip fasteners 100 have penetrated the purlin 102 and have been tightened to drive the bearing tabs 112 to compress the insulation 114 so that the clip base 92 is substantially mounted right against the upper surface of the flange of the purlin 102.

This provides a solid foundation for the clip base 92 on the purlin 102, as the bearing tabs 112 of the clip base 92 bear substantially directly against the purlin 102, reducing the amount of further compression of the insulation 114 and preventing lateral and longitudinal rocking of the clip base 92 in relation to the purlin 102.

A downward load on the roof panels will attempt to translate or rotate the roof purlin 102. As the roof purlin 102 tends to move, the roof panels by attachment to the clips 18 tend to resist the movement of the roof purlin 102. Without the bearing feet 112, there would remain some compressibility of the insulation 114 under the clip base 92, and the clip base in relation to the purlin flange could be rotated by the clip loading; this would tend to rotate clip base relative to the supporting purlin, resulting in applying substantially a point load through the insulation 114. This would further compress the insulation 114 until the insulation would compress no further, and in effect, the toe end of the clip base would bear directly on the roof purlin 102, at which point the load capacity of the purlin would have been compromised because it had been allowed to rotate in relation to the clip base.

Resisting purlin rotation, such as that which occurs in the previously known art, is achieved by the aforementioned transfer of load more directly to the supporting purlin flange. Stated simply, purlin rotation does not take place with the clip 18 until the purlin has rotated an amount that significantly reduces its ability to resist load.

In the present invention, the bearing feet 112 concentrate the total force exerted by the attachment fasteners 100 on the bearing feet 112, resulting in a more concentrated compression of the insulation 114 under the bearing feet 112 to the point the insulation cannot be compressed further by any significant amount, thus resisting any rotation of the clip base 92 in relation to the purlin flange. In effect, this causes the insulation 114 under the bearing feet 112 to provide a substantially solid base. The compressed insulation 114 therefore bears substantially directly on the roof purlin 102, so that as the roof purlin 102 tries to rotate as loading occurs, the load is immediately transferred to the roof panels through clip tab 20 and the clip base 92 which has close tolerance between it and the clip base 92 to resist purlin rotation before the roof purlin 102 has rotated to any significant degree. This immediate transfer of load allows the roof panels supported by the clips 18 to provide greater structural stability to the purlin.

The present invention assures complete sealant encapsulation of the clip tab of a clip connecting a standing seam assembly to underlying building structure, resulting in a more reliable watertightness seal throughout the complete length of the seams interconnecting metal building panels. Clip tab sealant encapsulation is accomplished by utilizing only a single sealant bead, preferably applied to the female sidelap, but it will be appreciated that the principles taught herein can as well be followed by applying the sealant to the top side of the male sidelap. Thus, the sealant can be automatically and economically applied to the full length of panels utilized to form a roof or a siding for such structures as pre-engineered metal buildings.

As will is clear from the above description of preferred embodiments of the invention, seam water tightness is accomplished by extruding the sealant through sealant extrusion holes in a clip tab into a sealant distributor channel created over and under the clip tab and over the upper surface of the male sidelap. The result is a continuous sealant dam between the male and female sidelaps having greater water tightness than that of the previous art while maintaining other desirable features, such as strength and aesthetic qualities. The location of the sealant on the female sidelap is coordinated with, and complementary to, the location of the sealant extrusion holes in the clip tabs.

The end edges of the each clip tab is provided with a sealant transition notch that is configured to channel the sealant on the female sidelap in such a manner as to form a continuous seal at the edges of the clip tab. That is, the ridges and valleys adjacent to the sealant transfer holes cause the sealant extruded through the sealant extrusion holes to form a continuous and effective water entry prevention dam. The clip tab notches can be provided with coined or configured edges, and as well, the clip sealant transfer holes can also be coined to assure even sealant flow, avoiding voids or channels through the sealant dam.

Staggering, or axially offsetting, the sealant extrusion holes creates a greater dimensional tolerance through which the sealant on the female sidelap can flow, helping to assure a uniform sealant dam. This also provides greater location tolerances for location of the sealant and the sealant extrusion holes, while also providing increased field assembly tolerances.

Figure 20:
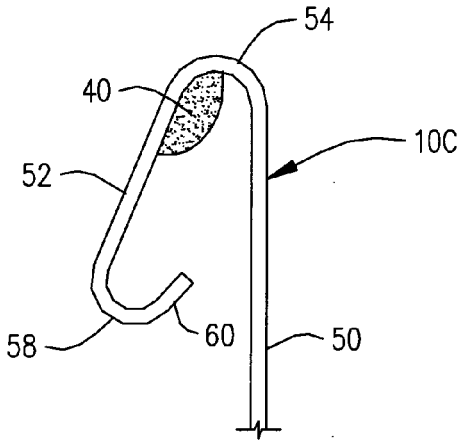
FIG. 20 is an elevational view of a female sidelap member constructed in accordance with the present invention
Figure 21:
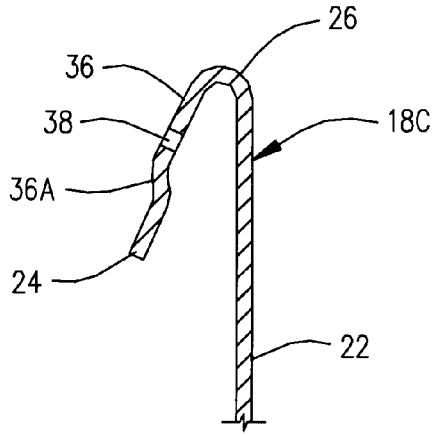
FIG. 21 shows a partially cutaway, cross-sectional, elevational end view of a clip member constructed in accordance with the present invention and configured for elastic joinder with the female sidelap of FIG. 20.
Figure 22:
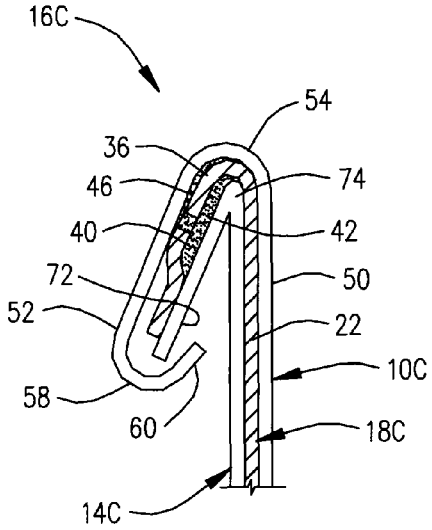
FIG. 22 is an assembled, elastically seamed standing seam assembly having the clip member of FIG. 21, the female sidelap of FIG. 20 and a male sidelap constructed in accordance with the present invention to form another embodiment of the standing seam assembly of the present invention.

Turning now to FIGS. 20 through 22, presented therein is another embodiment of the present invention in which a female sidelap 10C, a male sidelap 14C and a clip member 18C are depicted as forming a standing seam assembly 16C. Where the component parts are the same as those described herein above, identical component numbers are used in the subject drawings. Further description is believed to be unneeded as the purpose of including FIGS. 20-22 is to illustrate that the present invention can be incorporated in other embodiment shapes of the finally formed standing seam assembly, and the description provided hereinabove for the standing seam assembly 16 is incorporated here by reference for the standing seam assembly 16C. It will be noted that the mechanism for distribution of the sealant 40 is the same as that for initial assembly of the standing seam assembly 16; that is, the standing seam assembly 16C of FIG. 22 is elastically seamed and is commonly referred to as a snap-together seam.

FIG. 20 displays an elevational view of a female sidelap member 10C constructed in accordance with the present invention and having a sealant adhered to the underside of the female sidelap. FIG. 21 shows a partially cutaway, cross-sectional, elevational end view of a clip member 18C constructed in accordance with the present invention and configured for elastically joinder with the female and male sidelap member 10C.

FIG. 22 is an assembled, elastically seamed standing seam assembly 16C having the clip member 18C hooked over a male sidelap 14C joined with the female sidelap 10C to form the completed seam. As used herein, the term "elastically seamed" is a term of art referring to a standing seam assembly that has been assembled from its component parts without additional forming as provided by a seaming tool/machine; this is contrasted to a the term "inelastically seamed" which refers to a standing seam assembly that, after assembly from its component parts, is operated on by a seaming tool or seaming machine to be formed into its final shape.

The elastically seamed standing seam assembly 16C is assembled by placing the clip members 18C over the male sidelap 14C, following which the female sidelap 10C is placed over the members 18C and the male sidelap 14C. The application of a vertical force to the top of the female sidelap 10C will cause the female second leg member 52 to be forced away from female first leg member 50 within the elastic range of the material of the female sidelap 10 until the female fourth leg member 60 passes by the distal end of the male second leg 72, allowing the stresses induced as the female second leg member 52 was forced open during seaming to be released; this results in compression of the sealant 40 along the upper sealant chamber 46 through the clip sealant flow holes 38 and along the lower sealant chamber 42 in a similar manor as described for the inelastic seaming described above.

Figure 23:
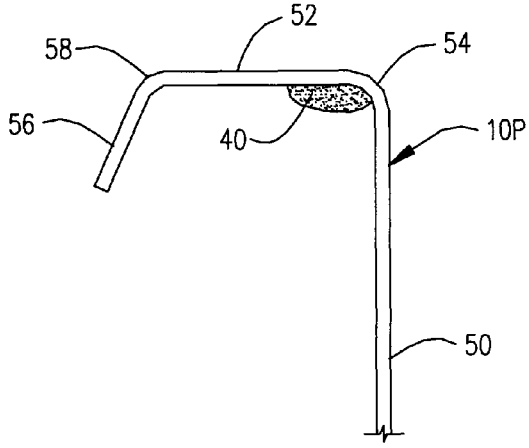
FIG. 23 PRIOR ART
FIGS. 23 through 26 illustrate the typical, state of the art elastically seamed standing seam assembly components that are typically are referred to as a snap-together seam.
Figure 24:
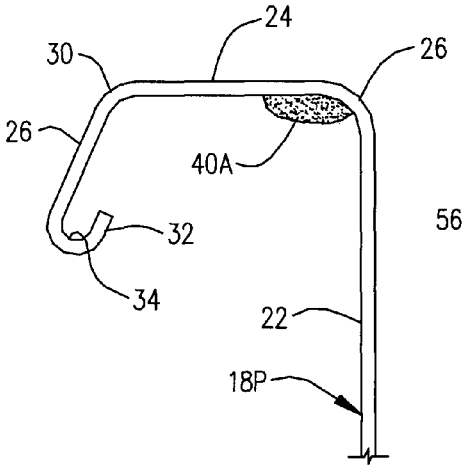
FIG. 24 PRIOR ART

FIGS. 23 through 26 illustrate the typical, state of the art elastic seam and panel clip. As a convenience to the reader, and to facilitate understanding, identical component numbers are depicted therein where the component parts are the same or similar to those described herein above for the standing seam assembly 16. FIG. 23 is an elevational end view of a female sidelap 10P representing one type of a state of the art seam having sealant 40 adhered to its underside. FIG. 24 is a cross-sectional, elevational end view of a typical prior art clip member 18P for assembly with the female sidelap 10P.

Figure 25:
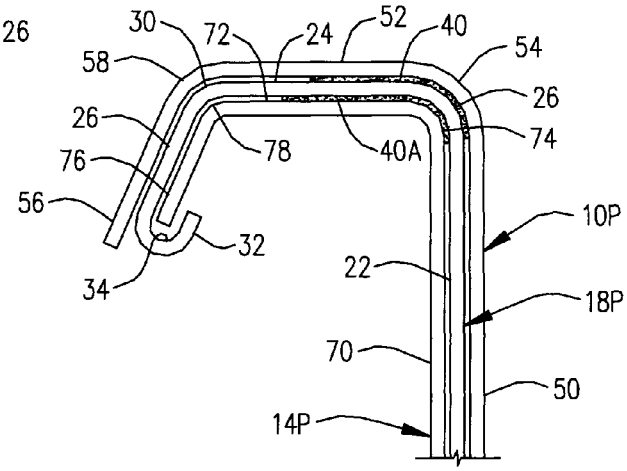
FIG. 25 PRIOR ART
Figure 26:
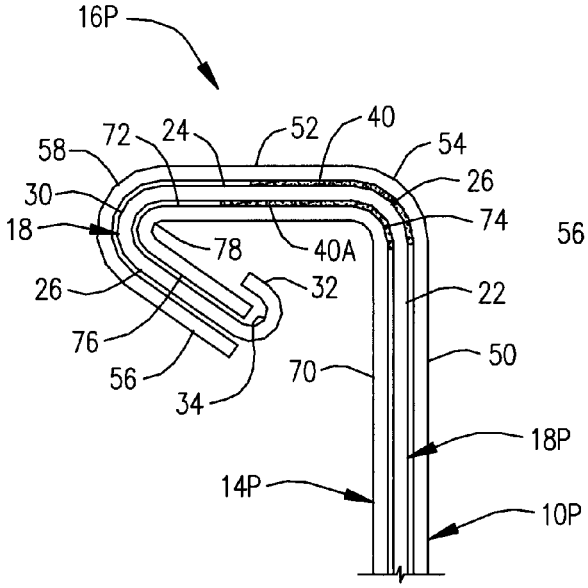
FIG. 26 PRIOR ART
Figure 27:
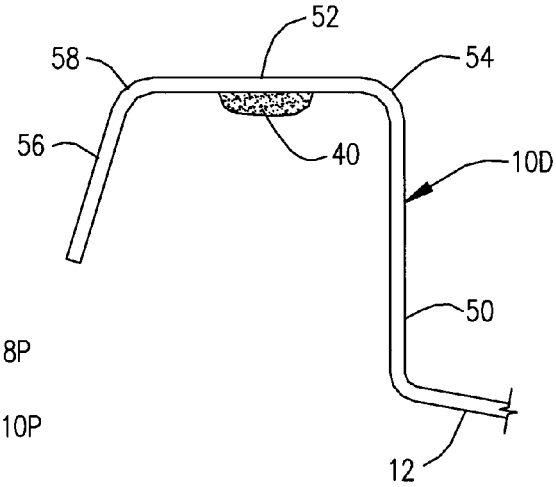
FIGS. 27 through 30 illustrate an alternate adaptation of the present invention utilizing only one sealant chamber and incorporating sealant both on the underside of the female sidelap and the clip member.

FIG. 25 is a cross-sectional, elevational end view of the initial joinder of the female sidelap 10P and clip member 18P with a male sidelap 14P configured to form therewith a prior art standing seam assembly 16P. FIG. 26 depicts the standing seam assembly 16P following seaming via a conventional seaming tool or seaming machine. A bead of sealant 40 and a bead of sealant 40 are adhered to the undersides of the female sidelap 10P and the clip member 18P, respectively, the sealants 40, 40A being positioned to merge when the standing seam assembly 16P is assembled.

As the panel sidelaps 10P, 14P are seamed, the seaming process results in compression of the sealant 40 between the underside of the female second leg member 52 and the top of male second leg member 72 to form a water resistant dam between clip members 18 at each clip member 18. The sealant 40 is compressed between the underside of the female second leg member 52 and the top of clip second leg member 24. The clip sealant 40A is adhered to the underside of the clip second leg member 24 in alignment with the position of the sealant 40 in the female sidelap.

It should be remembered that the clip members 18P in a typical installation are about 30 to 50 inches apart. As the seaming machine forms the standing seam assembly 16P, the resulting shape being that depicted in FIG. 26, the sealants 40, 40A are excessively compressed at each clip because of the additional thickness that the clip members 18 impart between the male and female sidelaps 14P, 10P at the clip locations. As is frequently the case, this excessive compression forces sealant to flow around the panel and clip elements, reducing the effectiveness of the seal.

Figure 30:
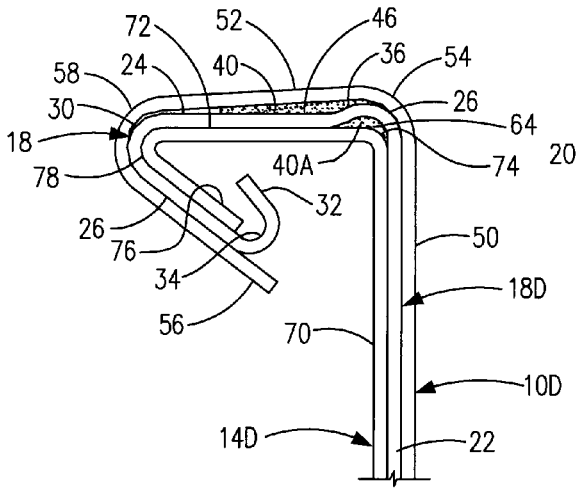

FIGS. 37 through 30 illustrate an alternate adaptation of the present invention utilizing only one sealant chamber and incorporating sealant both on the underside of the female sidelap and the clip member. As above, identical component numbers are utilized where the component parts are the same or similar to those described herein above for the standing seam assembly 16. FIG. 37 is an elevational end view of a female sidelap member 10D constructed in accordance with the present invention and having a sealant 40 adhered to its underside and located to accommodate the one sealant chamber adaptation of the present invention.

Figure 28:
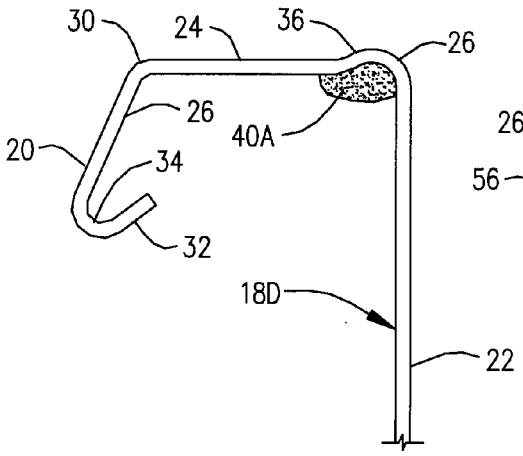
Figure 29:
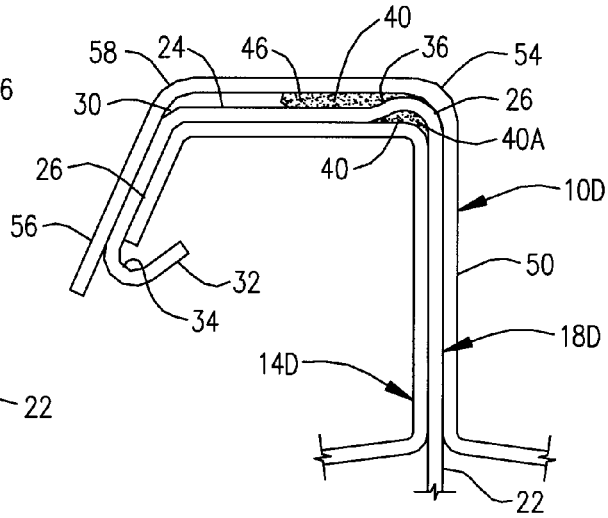

FIG. 28 is a cross-sectional, elevational end view of a clip member 18D adapted for the one sealant chamber with sealant 40A located on its underside. FIG. 29 depicts the joinder of the female sidelap 10D and clip member 18D with a male sidelap 14D configured for forming therewith a standing seam assembly 16D, shown in FIG. 29 prior to inelastic seaming by a seaming tool or seaming machine. FIG. 30 is a view of the standing seam assembly 16D after the seaming operation has formed it into its final shape at the clip locations.

The present invention, as illustrated in FIGS. 37 through 30, greatly improves the seal around the clip members 18D by forming a partially protected sealant upper chamber 46 between the underside of female second leg member 52, and the clip second leg member 24, the clip intermediate radius portion 30 clip, the second inclined portion 36 and the clip apex radius portion 26. The upper sealant chamber 46 assures that the sealant 40 will not flow away from its desired position over the clip sealant 40A. when compressed in the seaming operation. Further, the clip sealant 40A is prevented from over compression because it is contained in the lower sealant chamber 42 formed by the clip apex radius portion 26 and the clip second leg member 24 over the male second leg member 72.

Figure 31:
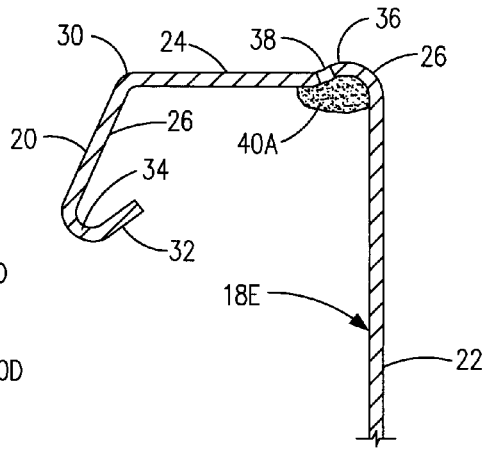
FIGS. 31 and 32 show yet another embodiment of the present invention.
Figure 32:
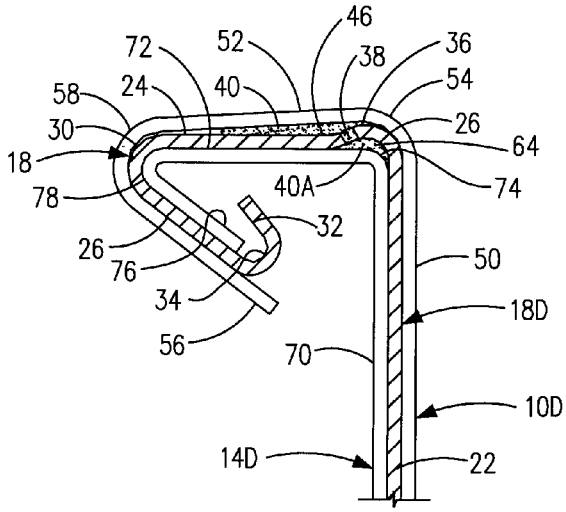

FIGS. 31 and 32 show another embodiment of the present invention. Clip sealant flow holes 38 are provided in the clip member clip first inclined portion 36 to permit and facilitate the merging of the sealant 40 with the sealant 40A above and below the clip members 18E. FIG. 32 shows the seamed standing seam assembly 16E and depicts the communication between the upper and lower sealant chambers 46, 42 via the sealant flow holes 38 in the clip member 18E, providing the benefits of the present invention as discussed and described above for the standing seam assembly 16.

It is clear that the present invention is well adapted to carry out the objects and to attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. In a standing seam roof assembly in which roof panels are supported by underlying support structure in overlapping edge relationship to form a standing seam assembly, the improvement comprising:

a male sidelap extending from a panel and having a male leg member;

a female sidelap extending from a second panel, the female sidelap having a female leg member shaped to fit over the male leg member;

sealant supported by one of the female leg member and the male leg member; and clip means for connecting the male and female sidelaps to the support structure, the clip means forming an upper sealant chamber and a lower sealant chamber, the sealant disposed in the upper and lower sealant chambers in the assembled mode and encapsulating a portion of the clip means, the clip means having a clip tab shaped to engage and be retained with the male leg member and the female leg member in the assembled mode, the clip tab having a clip inclined portion cooperating with the male and female leg members to form the upper and lower sealant chambers.

2. The standing seam roof assembly of claim 1 wherein the clip inclined portion has a sealant flow hole communicating between the upper and lower sealant chambers.

3. The standing seam roof assembly of claim 2 wherein the sealant is supported by the female leg member to align with the upper sealant chamber of the inclined portion of the clip tab in the assembled mode.

4. The standing seam roof assembly of claim 3 wherein the sealant is caused to partially extrude through the sealant flow hole from the upper sealant chamber to the lower sealant chamber while assuming the assembled mode.

5. The standing seam assembly of claim 4 wherein a portion of the sealant in the upper and lower sealant chambers is caused to flow around the edges of the clip tab in the assembled mode.

6. The standing seam assembly of claim 5 wherein the clip tab has a clip dimple portion supporting one end of the clip inclined portion.

7. In a standing seam roof assembly in which roof panels are supported by underlying support structure in overlapping edge relationship to form a standing seam assembly, the improvement comprising:

a male sidelap extending from a panel and having a male leg member;

a female sidelap extending from a second panel, the female sidelap having a female leg member shaped to fit over the male leg member;

sealant supported by one of the female leg member and the male leg member; and clip means for connecting the male and female sidelaps to the support structure, the clip means having a clip tab shaped to engage and be retained with the male leg member and the female leg member in the assembled mode, the clip tab having a clip inclined portion on the clip tab and cooperating with the male leg member and the female leg member to form a lower sealant chamber and an upper sealant chamber, the clip inclined portion having a sealant flow hole communicating between the upper sealant chamber and the lower sealant chamber, the sealant extruded between the upper sealant chamber and the lower sealant chamber to encapsulate a portion of the clip tab.

8. The standing seam roof assembly of claim 7 wherein the sealant is supported by the female leg member to align with the upper sealant chamber of the inclined portion of the clip tab in the assembled mode.

9. The standing seam roof assembly of claim 8 wherein the sealant is caused to partially extrude through the sealant flow hole from the upper sealant chamber to the lower sealant chamber while assuming the assembled mode.

10. The standing seam assembly of claim 9 wherein a portion of the sealant in the upper and lower sealant chambers is caused to flow around the edges of the clip tab in the assembled mode.

11. The standing seam assembly of claim 10 wherein the female leg has a clip dimple portion supporting one end of the clip inclined portion.

12. In a standing seam roof assembly in which roof panels supported by underlying support structure overlap to form a standing seam assembly, the improvement comprising:

a male sidelap extending from a first panel and having a male leg member;

a female sidelap extending from a second panel and supporting a bead of sealant, the female sidelap shaped to fit over the male sidelap;

a clip member having a clip tab shaped to hook over the male sidelap between the female sidelap and the leg member of the male sidelap, the clip tab having an inclined portion supported over the male leg member and forming a sealant chamber above and below the clip tab, the inclined portion having a sealant flow hole communicating from the sealant chamber above the clip tab to the sealant chamber below the clip tab.

13. The standing seam assembly of claim 12 in which sealant supported by the female leg member or the male leg member is caused to flow around the edges of the clip tab in the assembled mode.

* * * * *